United States Patent [19]

Smith

[11] Patent Number: 4,674,739

[45] Date of Patent: Jun. 23, 1987

[54] SHEET TRANSFER DEVICE

[75] Inventor: Edwin K. Smith, Haworth, N.J.

[73] Assignee: Corrugated Paper Machinery Corp., Hunt Valley, Md.

[21] Appl. No.: 762,117

[22] Filed: Aug. 2, 1985

[51] Int. Cl.[4] ..... B65H 5/14

[52] U.S. Cl. ..... 271/268; 271/270

[58] Field of Search ..... 271/270, 242, 243, 244, 271/245, 246, 247, 253, 254, 264, 266, 267, 268; 198/470.1, 803.9; 83/151, 327

[56] References Cited

U.S. PATENT DOCUMENTS 4,031,824 6/1977 Bubley et al. ..... 271/268 X 4,420,998 12/1983 Tokuno et al. ..... 83/325 X

FOREIGN PATENT DOCUMENTS 0555495 6/1957 Italy ..... 83/151

*Primary Examiner*—George E. A. Halvosa

*Assistant Examiner*—Matthew C. Graham

*Attorney, Agent, or Firm*—Saidman, Sterne, Kessler & Goldstein

[57] ABSTRACT

A conveyor belt transfer section moves printed sheets at constant speed from a printer to a platen type die-cutter, this constant speed being equal to the printer speed. The die-cutter is provided with an intermittently operated sheet conveyor having a gripper bar that is moved intermittently so as to fully stop in succession at a plurality of locations including an infeed station and a working station downstream of the infeed station. When the bar is stopped at the infeed station, sheet grippers mounted thereon are opened and are kept open while the bar is accelerated in the downstream direction. As a sheet approaches the infeed station, the bar begins to move away from the infeed station at an acceleration rate which permits the sheet to enter the open grippers on the moving bar. These grippers are closed to hold the sheet when sheet speed and gripper bar speed are essentially equal. With its grippers closed, the bar continues to accelerate, then decelerate and finally stops at the working station with the sheet operatively positioned between the platens of the die cutter.

16 Claims, 6 Drawing Figures

SHEET TRANSFER DEVICE

BACKGROUND OF THE INVENTION

This invention relates to sheet transfer devices in general and more particularly relates to means for transferring a moving sheet to gripper means on an intermittently operated conveyor chain.

Corrugated board box blanks are often made by platen-type cutting and creasing presses of the type described in the A.F. Shields U.S. Pat. No. 3,042,398, issued July 3, 1962 for a Sheet Gripping Means for cutting and Creasing Press. In the device of the aforesaid U.S. Pat. No. 3,042,398, the box blanks are made by platen mounted die means from sheets while the latter are held by grippers on a transfer gripper bar that is stationary while cutting and creasing takes place. The gripper bar is one of a series of similar bars that are equally spaced along a closed loop chain that is intermittently operated so that each gripper bar is moved between and stops at discrete locations, being stopped initially at a pickup location where a sheet is fed to the grippers, then moving downstream to a working position where the sheet is positioned between opposed platens which are operated to cut and crease the sheet, then moving downstream and stopping at a delivery location where the sheet which has been transformed into a box blank is released from the grippers. Thereafter, the gripper bar is moved to one or more additional discrete locations until arriving again at the pickup station where another sheet is fed to the grippers on the gripper bar or slat. In the prior art, the grippers at the feeding station usually closed on the sheet while the feed slat was stopped. Because of this, the sheet was subjected to rapid acceleration and deceleration which became troublesome when the sheets were fed from a printer to the cutting and creasing press.

More particularly, in the prior art when corrugated sheets emerged from the printer they were received by a two-section conveyor belt device having pressure rollers to hold the sheets on the belt. The first conveyor belt section operates at a speed to convey sheets at the same speed as the printer. However, the speed of the second or downstream conveyor belt section is approximately 50% faster than the speed of the upstream conveyor section to increase the spacing between the trailing edge of one sheet and the leading edge of the sheet immediately upstream thereof. This increased spacing will be reduced when the leading sheet is stopped to be engaged by the grippers of the gripper bar that is stopped at the infeed position.

This two-belt, two-spaced conveyor arrangement often causes the sheets to skew randomly when accelerating from low to high speed. In addition, any skewing of the sheets entering the transfer section tends to increase as speed changes. While the leading edge of the sheet may be squared by stops at the infeed station, variation in lateral position of the sheet across the machine occurs during squaring, since at this time the sheet tends to pivot around the stop that is first contacted by the sheet.

SUMMARY OF THE INVENTION

In accordance with the instant invention, sheets traveling at the same speed at which they leave the printer are received by the grippers while the gripper bar is in motion. More particularly, shortly before a sheet reaches grippers that are stopped at the pickup station, the gripper bar accelerates, but only fast enough to permit the leading edge of the sheet to catch up to or overlap with the open grippers. The latter are closed on the sheet when sheet speed and gripper bar speed are substantially equal. A single-speed transfer belt means is utilized for transferring the sheet from the printer to the grippers, with the conveyor speed being equal to printer speed. This arrangement results in accurate registration between sheet edges, printing and die cuts. In addition, relative motion between the sheet and belt during sheet transfer, sheet registration, sheet pickup and sheet forwarding is greatly reduced, thereby minimizing scuffing of the sheet and the possibility of smearing freshly printed ink.

If it becomes desirable to provide a small degree of reregistration to correct for errors in positioning of sheets as they are fed from the downstream end of the printer, stops may be provided on each gripper. With this arrangement, sheets are timed slightly ahead of their theoretically correct position and as a result will be urged against these stops during a period when the open grippers are accelerating. In this mode, the sheets do not stop, but merely hesitate slightly. An alternate arrangement for sheet reregistration includes stops that are attached to and move with the cross member that carries protrusions for opening the grippers. A first cam operates the cross member vertically upward for opening the grippers and a second cam operates simultaneously to move the cross member downstream at a speed equal to the speed of the gripper slat. When sheet speed and gripper slat speed are equal, the cross member moves downward very rapidly to close the grippers and move the stops below the work path.

Accordingly, the primary object of the instant invention is to provide novel means that will permit transfer of closely spaced corrugated sheets from an array moving at constant velocity in a printing unit to accelerating grippers carried by an intermittently operated conveyor chain of a cutting and creasing press.

Another object is to provide apparatus of this type in which sheets move through a transfer section at constant speed equal to printer speed.

Still another object is to provide apparatus of this type in which sheet speed and gripper bar speed are essentially equal as the grippers are closed on the sheet.

A further object is provide apparatus of this type having movable indexing stops.

A still further object is to provide apparatus of this type that is constructed so as to minimize scuffing of the sheets and smearing of freshly printed ink.

BRIEF DESCRIPTION OF THE DRAWINGS

These objects as well as other objects of this invention shall become readily apparent after reading the following description of the accompanying drawings in which.

DESCRIPTION OF THE PREFERRED EMBODIMENTS

Figure 1:
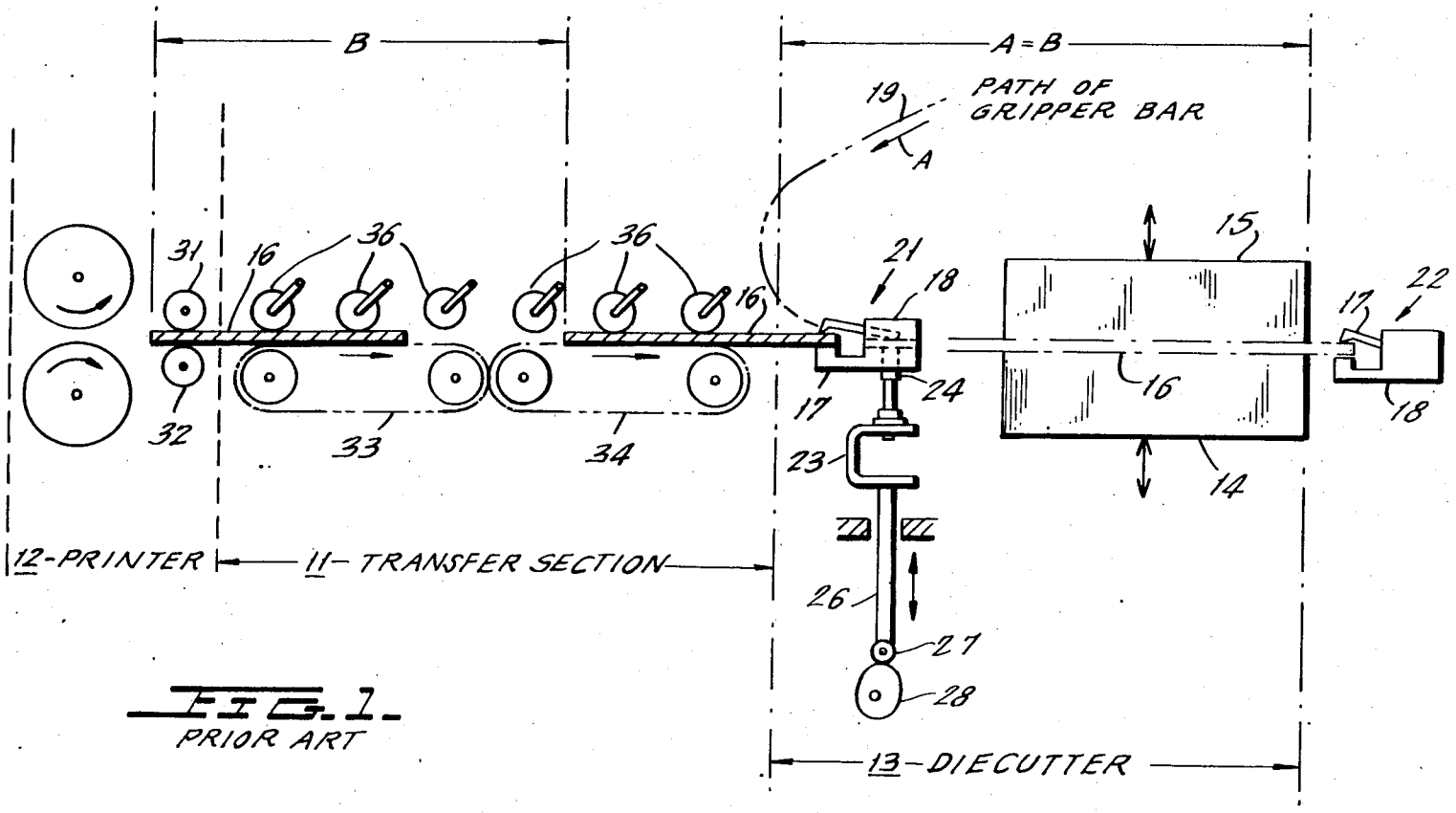
FIG. 1 PRIOR ART
FIG. 1 is a side elevation in schematic form illustrating a prior art sheet transfer section that is interposed between a printer and a cutting and creasing press.

Now referring to FIG. 1 illustrating a typical prior art construction wherein sheet transfer section 11 is interposed between printer 12 and cutting and creasing unit 13, otherwise known as a die cutter. The latter is the type of apparatus described in detail in the aforesaid U.S. Pat. No. 3,042,398 and includes opposed relatively movable platens 14, 15, one of which carries cutting and creasing dies that operate on a corrugated board sheet 16 whose leading edge is held by a plurality of sheet grippers 17 that are spaced along the length of transverse gripper bar 18. There are a plurality of gripper bars 18 that are equally spaced along closed loop conveyor chain 19 which consists of two parallel chains sections that are connected to opposite ends of gripper bars 18. Chain 19 is operated intermittently so that each gripper bar 18 is operated with a stepping motion so that it stops at a plurality of stations including infeed or sheet receiving station 21, and working station 22 that is downstream of station 21. With gripper bar 18 stopped at working station 22, sheet 16 held by grippers 17 thereon is disposed between platens 14, 15 for engagement by cutting and creasing dies carried by one of these platens 14, 15.

When gripper bar 18 is stopped at infeed station 21, vertically movable gripper opening channel 23 is disposed below and extends parallel to gripper bar 18. Spaced along the length of channel 23 and protruding upward therefrom are a plurality of opening screws or other pin-like devices 24, one for each of the sheet grippers 17. Extending downward from channel 23 at each end thereof is arm 26 having follower 27 rotatably mounted at its lower end. Follower 27 is in engagement with cam 28 that rotates in timed relation with movement of chain 19 so that when the latter is stopped, channel 23 is raised and screws 24 open grippers 17 on gripper bar 18 at station 21 prior to arrival of a sheet 16. Just prior to movement of gripper bar 18 downstream from station 21, cam 28 causes channel 23 to be lowered, thereby permitting biasing springs 29 (FIG. 3) to close grippers 17. At a delivery station downstream of working station 22, a channel (not shown) similar to channel 23, and its vertical motion operating means (not shown) are provided to open grippers 17 for release of sheet 16.

Before reaching die cutter 13, each of the sheets 16 is operated on by printer 12 and is ejected therefrom by passing between opposed delivery rollers 31, 32, at least one of which is driven. Upon leaving printer 12, sheet 16 is received on the upper flight of closed loop belt 33 in transfer section 11 and is then delivered to closed loop belt 24 of transfer section 11. During movement of sheet 16 through transfer section 11, transverse rollers 36 ride on the upper surface of sheet 16 to provide a downward force that serves to minimize slippage between 16 and belts 33, 34. The linear speed of upstream belt 33 matches the speed of sheet 16 as it is passed through printer 12 and is being delivered by rollers 31, 32. However, the linear speed of downstream belt 34 is substantially greater (typically one and a half times) the speed of belt 33. This faster speed of downstream belt 34 serves to increase the spacing between the trailing edge of one sheet 16 and the leading edge of the next upstream sheet 16. It has been found that major problems concerning skewing of sheets 16 are attributable to the substantial difference in speed between transfer section conveyor belts 33 and 34.

Figure 2:
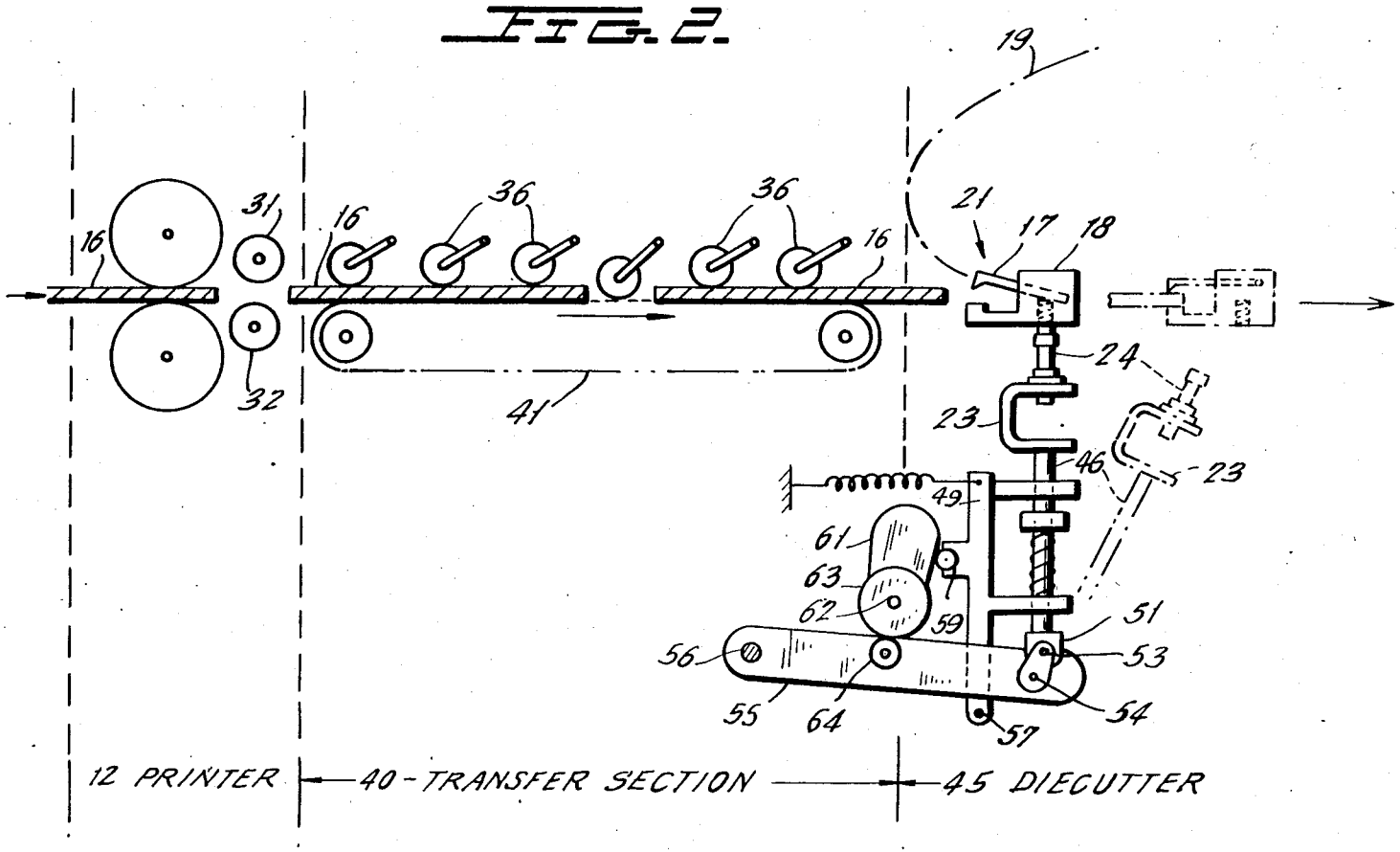
FIG. 2 is a side elevation in schematic form of the apparatus of FIG. 1 modified in accordance with teachings of the instant invention.

Now referring more particularly to the remaining figures (FIGS. 2–6), and at this point more particularly to FIG. 2 wherein elements that are common to FIGS. 1 and 2 are identified by the same reference numerals. The essential differences between the prior art device of FIG. 1 and the device of FIG. 2, the latter being constructed in accordance with this invention, is that transfer section 40 operates so that sheet 16 travels therethrough at uniform speed equal to the same speed sheets 16 travel through printer 12. That is, the linear speed of transfer section closed loop conveyor belt 41 is equal to the speed at which sheets 16 are delivered from printer 12 by rollers 31, 32 thereof. The other difference between the devices of FIGS. 1 and 2 is that in the latter, gripper bar 18 is moving downstream before it begins to close on the leading edge of a sheet 16 that is being delivered by transfer section 40. That is, conveyor chain 19 is still intermittently operated and grippers 17 are opened while gripper slat 18 is stopped at infeed station 21. However, this gripper bar 18 with its grippers 17 open begins to move downstream before the leading edge of sheet 16 reaches grippers 17.

Figure 6:
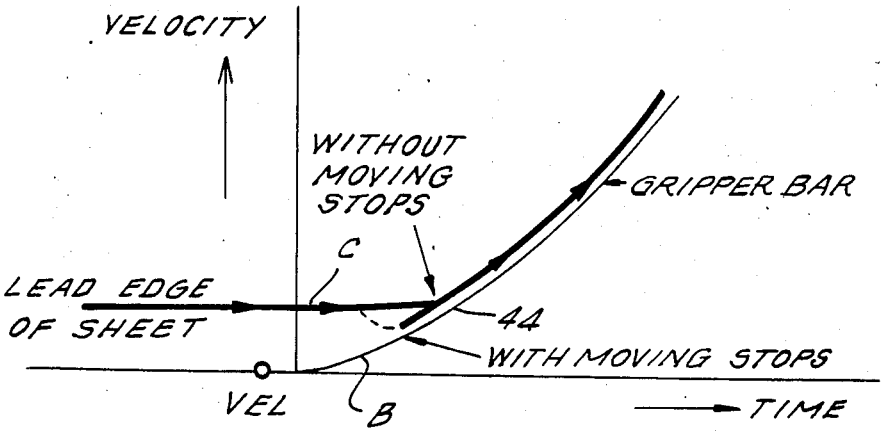
FIG. 6 is a timing diagram for the apparatus of FIG. 2 showing sheet speed in relation to gripper bar speed.

The left-hand portion of curve B in FIG. 6 shows the increasing velocity of gripper bar 18 as it moves downstream from its stopped position at infeed station 21 as compared to the speed C of sheet 16 in transfer section 40. The speed of sheet 16 being greater than the speed of gripper bar 18 while the latter is in its initial accelerating phase, and the leading edge of sheet 16 enters the open grippers 17. Ideally, the latter are not closed until the speed of gripper bar 18 equals the speed of sheet 16 in transfer section 40 (point 44 on gripper bar speed curve B).

Figure 3:
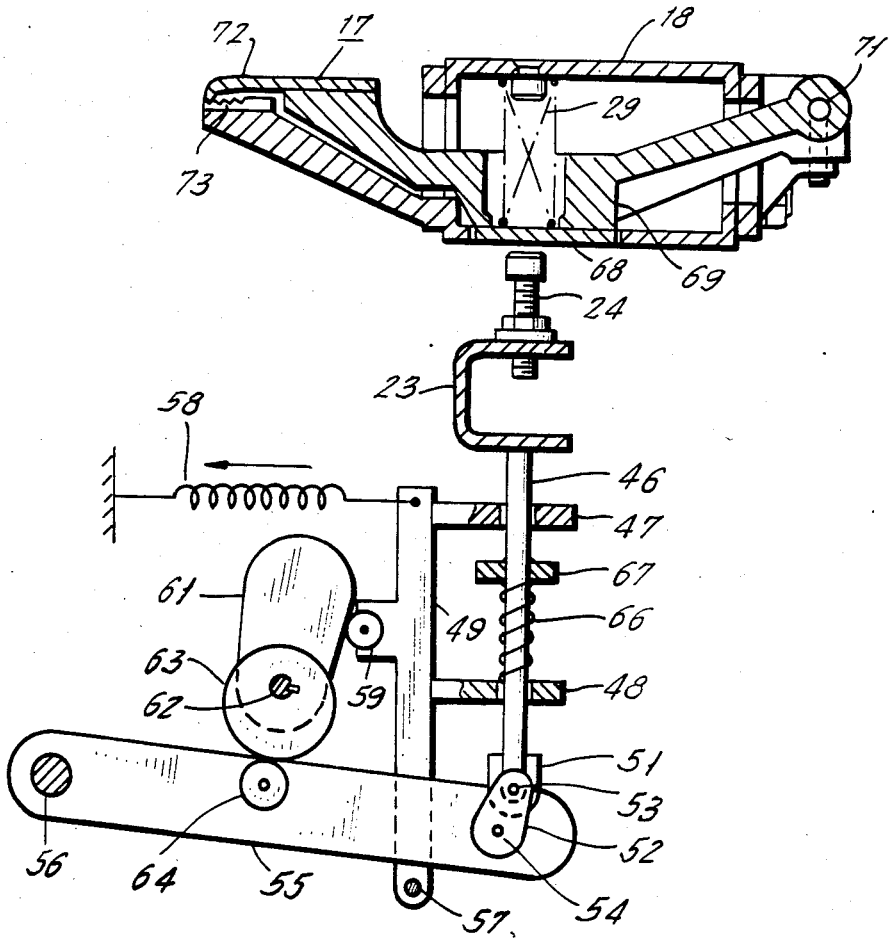
FIG. 3 is a side elevation in schematic form of the sheet gripper opening means in the embodiment of FIG. 2.
Figure 4:
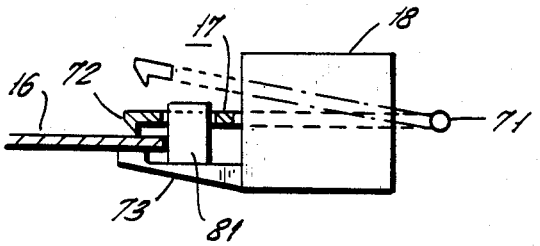
FIG. 4 is a side elevation of an embodiment wherein indexing stops are secured to the sheet grippers.

A suitable apparatus for opening grippers 17 at infeed station 21 and maintaining them open during the initial acceleration portion of movement for gripper bar 18 is illustrated in FIG. 3, wherein gripper opening channel 23 is secured to the upper end of rod 46 that is slidably mounted for generally vertical movement in spaced guide apertures formed in transverse projections 47, 48 of tilt link 49. The lower end of rod 46 is secured to block 51 that is mounted to link 52 at pivot 53. Pivot 54, which is laterally spaced from pivot 53 mounts link 52 to one end of opening link 55 whose other end is mounted to stationary pivot 57 and the upper end of tilt link 49 is connected to tension spring 58 which serves to bias link 49 counter-clockwise about its pivot 57 so that follower 59 on tilt link 49 is biased into engagement with forward motion cam 61. The latter is keyed to shaft 62 so as to rotate therewith. Also keyed to shaft 62 is gripper opening cam 63 that is engaged by follower 64 mounted on opening link 55 intermediate the ends thereof. Compression spring 66 biases rod 46 upward by bearing against guide extension 48 and collar 67 clamped to rod 46 below guide extension 49. This upward biasing of rod 46 biases follower 64 against gripper opening cam 63.

Upward movement of rod 46 moves screw 24 upward into engagement with plate 68 at the bottom of movable gripper element 69 whose downstream end is mounted to hollow gripper bar 18 on pivot 71. In moving upward, screw 24 causes member 69 to pivot clockwise, thereby raising movable gripper jaw 72 to separate the latter from stationary gripper jaw 73 to open gripper 17. The upward or jaw opening motion of channel 23 takes place under the influence of spring 66 as permitted by the position of cam 63. The shape of cam 63 is such that gripper 17 remains open until the speed of accelerating conveyor chain 19 and gripper bar 18 carried thereby is equal to the speed of sheet 16 in transfer section 40. At the same time, forward motion cam 61 pivots tilt link 49 clockwise, thereby tilting rod 46 so that the upper end thereof moves downstream at a speed which matches the speed of the accelerating gripper bar 18.

Figure 5:
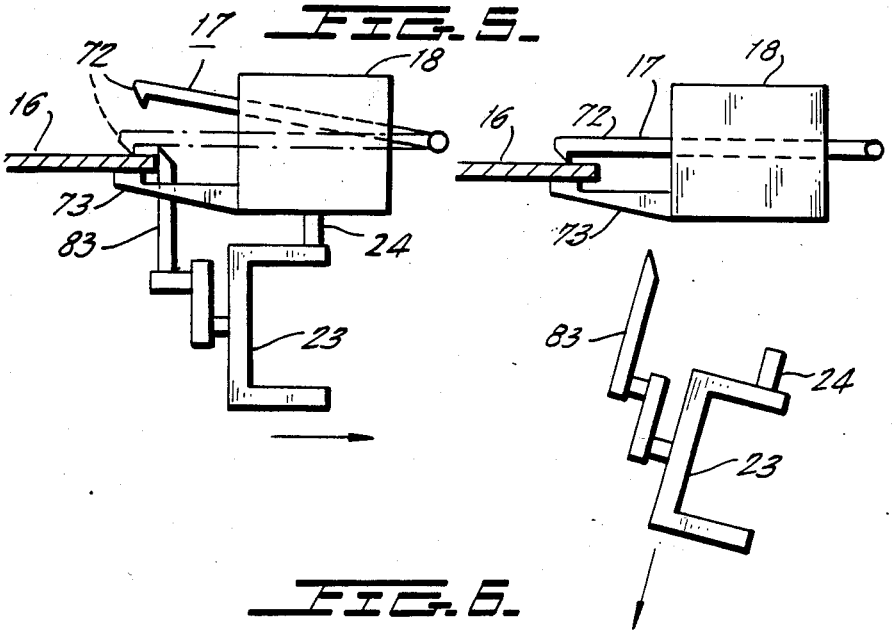
FIG. 5 is a side elevation in schematic form illustrating registration stops that are movable together with means for opening the grippers.

To obtain improved registration between sheet 16 and grippers 17, each gripper 17 may be provided with stop 81 (FIG. 4) that is secured to lower jaw 17 and extends upward through aperture 77 in movable jaw 72 when the latter is in its closed position. An alternate construction for registrations stops is illustrated in Fig. 5. In the latter embodiment, so-called movable stops 83 are mounted to the upstream side of opening channel 23 so as to be movable with the latter. When channel 23 is in its raised position to open grippers 17, stops 83 extend above lower stationary jaw 73 so as to be engaged by the leading edge of sheet 16 as it moves between the open jaws 72, 73. With the embodiment of FIG. 5, to minimize vertical movement of channel 23, stops 83 may be actuated by cams or other means so as to be in their upper or registered position during sheet pickup but then retract downward to avoid interference with gripper bar 18 as it is moving into infeed station 21.

In constructions which utilize stops 81 or stops 83 for slight reregistration of sheet 16, the mechanism elements are timed or phased so that the lead edge of sheet 16 is slightly ahead of its theoretical correct position at which sheet speed and gripper bar speed are precise equals, and will therefore be urged against these stops 81 or 83 during the initial acceleration of the open grippers 17 as gripper bar 18 moves downstream from infeed station 21. Using this timing arrangement sheets 16 do not stop during the infeeding operation but merely hesitate slightly. This type of stop arrangement is also suitable for registering sheets with grippers that are mounted on a conveyor chain that moves continuously at uniform speed.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Sheet processing apparatus including:

a first section, a second section downstream of said first section, and a transfer section which receives sheets issuing from said first section in tandem and delivers said sheets to said second section through the infeed end of said second section;

said first section delivering sheets traveling at a first speed to said transfer section;

said transfer section including means for moving sheets nonstop through said transfer section at said first speed;

said second section including sheet gripper means for receiving sheets delivered to said second section by said transfer section, and an intermittent conveyor for carrying said gripper means in steps along a closed loop path that includes a working portion in which said gripper means moves away from said transfer section;

said working portion including a sheet pickup region extending downstream of said infeed end a work station downstream of said pickup region; said pickup region having an upstream end and a downstream end; said gripper means being open at said upstream end of said pickup region and initially closing when said gripper means reaches said downstream end of said pickup region; said second section also including means for operating on a sheet while said sheet is held by said gripper means and stopped at said working station;

said conveyor moving said gripper means non-stop from a position upstream of said pickup region, through said pickup region to a stop position downstream of the pickup region;

said conveyor accelerating said gripper means as the latter approaches and moves through said pickup region and for a portion of the distance between the pickup region and the stop position;

said gripper means being open while moving through the upstream end of the pickup region and during that time traveling downstream at a speed less than said first speed;

said gripper means when at said upstream end of said pickup region initially receiving a leading edge of a sheet being delivered to said pickup region at said first speed by said transfer means;

said gripper means upon reaching said first speed being disposed at said downstream end of said pickup region where said gripper means closes on said leading edge; and said gripper means continuing to accelerate after closing thereof to accelerate a sheet held thereby until said gripper means reaches a point downstream of said pickup region, and then said gripper means and the sheet held thereby decelerate until said gripper means stops at the stop position and the sheet stops at said working station.

2. Sheet processing apparatus as set forth in claim 1 in which the second section also includes register means carried by said gripper means and being operatively positioned for engagement by a sheet while said gripper means is open and moving downstream in said pickup region to position the leading edge of such sheet perpendicular to the direction of sheet travel without materially impeding downstream movements of such sheet.

3. Sheet processing apparatus as set forth in claim 1 in which the second section also includes register means at said pickup region movable from an operating position at said working portion of said path to a retracted position remote from said working portion; said register means being moved to said retracted position upon closing of said sheet gripper means; said register means while in said operating position moving downstream in said pickup region together with said gripper means prior to full closing of the latter; said register means when in said operating position being operatively positioned for engagement by a sheet to position its leading edge perpendicular to direction of sheet travel along said working portion of said path; said register means moving downstream in said pickup region at a speed that will not materially impede downstream movement of a sheet traveling at said first speed and having its leading edge in engagement with said register means.

4. Sheet processing apparatus as set forth in claim 3 in which the gripper means is biased-closed, a cam operated first means for opening said gripper means as it moves downstream in said pickup region, a cam operated second means for moving said register means between said path and said retracted position, and cam operated third means for moving said register means downstream in said pickup region in unison with said gripper means.

5. Sheet processing apparatus as set forth in claim 4 in which the first and second means are provided with a common operating cam.

6. Sheet processing apparatus as set forth in claim 1 in which the first section includes a printer and the second section includes a die cutter disposed at said working station.

7. Sheet processing apparatus as set forth in claim 6 in which the transfer section comprises a continuously operating belt-type conveyor.

8. Sheet processing apparatus as set forth in claim 7 in which the second section also includes register means carried by said gripper means and being operatively positioned for engagement by a sheet while said gripper means is open and moving downstream in said pickup region to position the leading edge of such sheet perpendicular to the direction of sheet travel without materially impeding downstream movements of such sheet.

9. Sheet processing apparatus as set forth in claim 7 in which the second section also includes register means at said pickup region movable from an operating position at said working portion of said path to a retracted position remote from said working portion; said register means being moved to said retracted position upon closing of said sheet gripper means; said register means while in said operating position moving downstream in said pickup region together with said gripper means prior to full closing of the latter; said register means when in said operating position being operatively positioned for engagement by a sheet to position its leading edge perpendicular to direction of sheet travel along said working portion of said path; said register means moving downstream in said pickup region at a speed that will not materially impede downstream movement of a sheet traveling at said first speed and having its leading edge in engagement with said register means.

10. Sheet processing apparatus as set forth in claim 9 in which the gripper means is biased-closed, a cam operated first means for opening said gripper means as it moves downstream in said pickup region, a cam operated second means for moving said register means between said path and said retracted position, and cam operated third means for moving said register means downstream in said pickup region in unison with said gripper means.

11. Sheet processing apparatus as set forth in claim 10 in which the first and second means are provided with a common operating cam.

12. Sheet processing apparatus as set forth in claim 11 in which the first section includes said printer for applying indicia to sheets as they move through said first section and the second section includes said die cutter for operating on sheets while they are stopped at said working station.

13. Sheet processing apparatus as set forth in claim 2 in which the first section includes a printer for applying indicia to sheets as they move through said first section and the second section includes a die cutter for operating on sheets while they are stopped at said working station.

14. Sheet processing apparatus as set forth in claim 3 in which the first section includes a printer for applying indicia to sheets as they move through said first section and the second section includes a die cutter for operating on sheets while they are stopped at said working station.

15. Sheet processing apparatus as set forth in claim 4 in which the first section includes a printer for applying indicia to sheets as they move through said first section and the second section includes a die cutter for operating on sheets while they are stopped at said working station.

16. A sheet processing apparatus including:

a sheet processing section, and a feeder section which delivers sheets to said processing section through its infeed end;

said feeder section delivering sheets traveling at a first speed to said processing section;

said processing section including sheet gripper means for receiving sheets delivered to said processing section by said feeder section, and a conveyor for carrying said gripper means along a closed loop path that includes a working portion in which said gripper means moves away from said feeder section;

said working portion including a sheet pickup region extending downstream of said infeed end and a work station downstream of said pickup region; said pickup region having an upstream end and a downstream end; said gripper means being open at said upstream end of said pickup region and initially closing when said gripper means reaches said downstream end of said pickup region; said processing section also including means for operating on a sheet while said sheet is held by said gripper means and is positioned at said working station;

said conveyor moving said gripper means non-stop from a position upstream of said pickup region, through said pickup region and downstream thereof;

said gripper means being open while moving through the upstream end of the pickup region and when at said upstream end of said pickup region initially receiving a leading edge of a sheet being delivered to said pickup region by said feeder means;

said gripper means upon reaching said downstream end of said pickup region being closed on said leading edge while said sheet and said gripper means are moving at essentially the same speed;

register means carried by said gripper means and being operatively positioned for engagement by a sheet while said gripper means is open and moving downstream in said pickup region to position the leading edge of such sheet perpendicular to the direction of sheet travel;

said feeder means and said gripper means having their downstream movements phased to cause slight hesitation in downstream movement of sheets as the latter engage said register means.

* * * * *

UNITED STATES PATENT AND TRADEMARK OFFICE

CERTIFICATE OF CORRECTION

PATENT NO. : 4,674,739

DATED : June 23, 1987

INVENTOR(S) : EDWIN K. SMITH

It is certified that error appears in the above—identified patent and that said Letters Patent is hereby corrected as shown below:

Column 4, line 51, after the word "pivot" insert --56. The lower end of tilt link 49 is mounted to stationary pivot--.

Signed and Sealed this

Eleventh Day of October, 1988

*Attest:*

DONALD J. QUIGG

*Attesting Officer*

*Commissioner of Patents and Trademarks*